US005810220A

United States Patent [19]

Petersen

[11] Patent Number: 5,810,220

[45] Date of Patent: Sep. 22, 1998

[54] FOREARM POSTAL TRAY

[76] Inventor: Robert Petersen, 821 Lebanon St., Aurora, Ill. 60505

[21] Appl. No.: 898,846

[22] Filed: Jul. 25, 1997

Related U.S. Application Data

[63] Continuation of Ser. No. 664,844, Jun. 17, 1996, abandoned.

[51] Int. Cl.[6] ..... A45F 5/00

[52] U.S. Cl. ..... 224/222; 224/267; 224/270; 108/43

[58] Field of Search ..... 224/191, 219, 224/220, 221, 222, 267, 270; 108/43; 206/449

[56] References Cited

U.S. PATENT DOCUMENTS

| | | | |
|---|---|---|---|
| 853,577 | 5/1907 | Connell | 224/222 |
| 1,609,481 | 12/1926 | McCarthy et al. | 224/219 |
| 1,786,254 | 12/1930 | Meehan | 224/222 |
| 2,600,092 | 6/1952 | Buelow | 224/219 |
| 3,162,344 | 12/1964 | Sabol . | |
| 3,215,453 | 11/1965 | Malcom, Jr. | 108/43 |
| 3,232,685 | 2/1966 | Wilstein et al. | 224/267 |
| 3,315,858 | 4/1967 | Horner . | |
| 3,504,832 | 4/1970 | Corvetti . | |
| 3,754,646 | 8/1973 | Henig | 206/73 |
| 3,885,668 | 5/1975 | McClain | 206/73 |
| 3,941,286 | 3/1976 | Perkinson . | |
| 3,942,194 | 3/1976 | Winter | 224/219 |
| 3,955,672 | 5/1976 | Brundage | 206/72 |
| 4,013,213 | 3/1977 | Giebel | 229/39 R |
| 4,243,249 | 1/1981 | Goss | 108/43 |
| 4,254,872 | 3/1981 | Garrett | 206/561 |
| 4,401,233 | 8/1983 | Frey | 224/219 |
| 4,484,685 | 11/1984 | Williams | 209/703 |
| 5,025,919 | 6/1991 | Brinker et al. | 224/277 |
| 5,207,347 | 5/1993 | Wilkey | 220/541 |
| 5,323,910 | 6/1994 | van de Graaf, Jr. | 206/557 |

*Primary Examiner*—Allan N. Shoap
*Assistant Examiner*—Gregory M. Vidovich
*Attorney, Agent, or Firm*—James P. Hanrath

[57] ABSTRACT

A forearm postal tray is an aid for the sorting and delivery of articles of mail and the like and comprises an arch braced member for setting on a user's forearm by a securing strap. A tray plate is rotatably and selectively connected to the arched brace member by a screw. The tray plate has an end wall along a portion of its length and a side wall along a portion of its width, such that articles of mail may be set upon the tray plate without being displaced therefrom and without requiring the user to hand hold the same in place.

10 Claims, 2 Drawing Sheets

FIG. 1
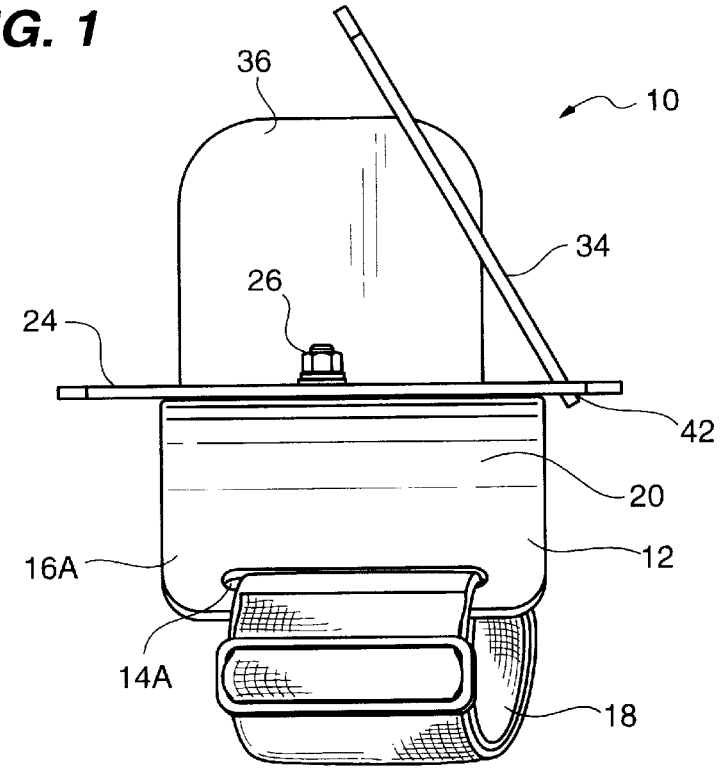
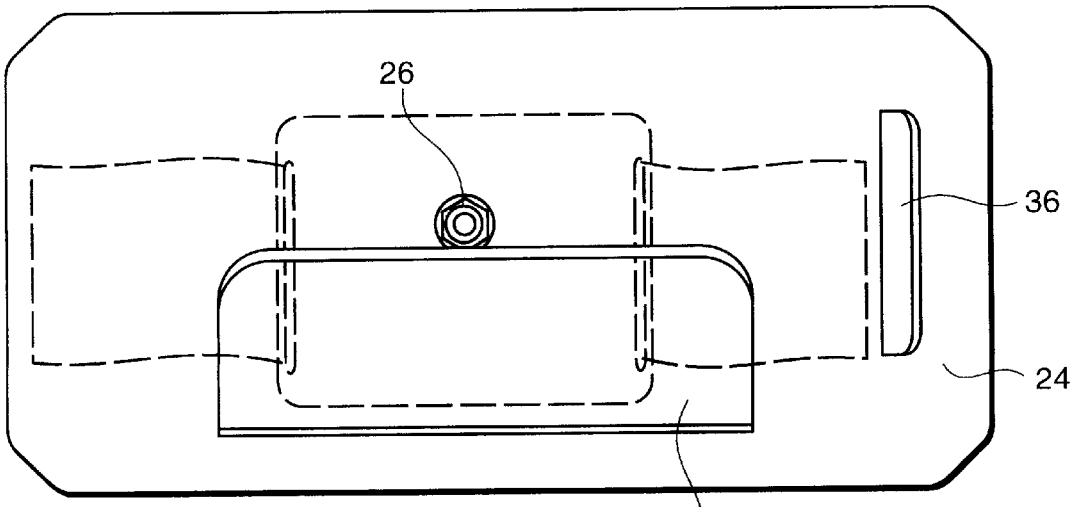
FIG. 2

FOREARM POSTAL TRAY

This is a continuation of application Ser. No. 08/664,844 filed on Jun. 17, 1996 now abandoned.

BACKGROUND OF THE INVENTION

1. Field of the Invention.

This invention relates to apparatus for facilitating the sorting and delivery of articles of mail or the like. More particularly, it relates to a forearm postal tray to aid in sorting operations and mail carrier delivery of bundles of mail.

2. Description of the Related Art

The volume of mail in the United States is enormous reaching approximately 180.7 billion pieces of mail in 1995. Mail carrier and route delivery personnel receive batches of mail sequentially sorted for delivery to particular postal addresses by various automated or manual sorting procedures. Such mail may be stored in various sorting, carrying, and delivery trays, bins, racks, or organizers such as the apparatus disclosed in U.S. Pat. No. 5,207,347, U.S. Pat. No. 4,484,685, U.S. Pat. No. 3,885,668 and U.S. Pat. No. 3,754,646. Such apparatus aids postal delivery personnel to organize mail as they set forth upon their postal routes.

A problem soon develops, however, in that despite automated and manual sorting of mail by sequenced route delivery addresses with associated apparatus for storage and organization of the same, due to the sheer volume of mail sometimes mail is mixed in an improper sequence. Further, there arises a need to process automated sequenced bundles of mail with separate manual sequenced bundles of mail. Postal delivery personnel must necessarily check the sequencing of the automated and manual organization of the mail to correct and reorganize the mail, and must collate automated sequenced bundles of mail with manual sequenced bundles of mail, each time a delivery to the next customer on the postal route is required. Thus, despite automated and manual sorting operations and the storage of sequentially ordered route mail in various bins, trays, or organizers, mail route carriers must still examine, compare, and collate the automated and manual pre-sorted bundles of mail corresponding to sequential delivery addresses to ensure the bundles are in proper sequence at the time of mail delivery.

The forearm postal tray serves as an aid to mail carrier and delivery personnel enabling them to carry and sort a greater volume of mail in a more expedient manner.

SUMMARY OF THE INVENTION

In accordance with the present invention, there is provided a forearm tray for facilitating sorting and delivery of articles of mail and the like comprising an arched brace member for setting on a user's forearm, the arched brace member being cooperative with means, such as a strap, for securing the brace member to the forearm of a user, a tray plate connected to the arched brace member, the tray plate having an end wall and a side wall extending upwardly therefrom.

The postal forearm tray of the present invention allows mail carrier and route delivery personnel to conveniently and efficiently examine, compare, and collate automated sequential ordered bundles of mail with separate manual sequential ordered bundles of mail at the time of delivery to corresponding sequential addresses along postal routes.

For example, when the forearm postal tray of the present invention is worn upon the left underside forearm of a user, automated sequential ordered bundles of mail may be placed upon the tray plate of the forearm postal tray while manually sorted sequential bundles of mail may be held in the user's left hand. The mail carrier's right hand is now free to aid in the sorting of both the automated sequential ordered bundles and manual sequential ordered bundles, as well as sorting of the collection of postal letters and materials making up the bundles, to compare, examine, and collate the same to each other at the several points of route postal delivery.

BRIEF DESCRIPTION OF THE DRAWINGS

FIG. 1 is a side view of a forearm postal tray according to the present invention.

FIG. 2 is a top view of the forearm postal tray illustrated at FIG. 1.

DESCRIPTION OF THE PREFERRED EMBODIMENTS

Referring now more particularly to the drawings, and to that embodiment of the invention herein presented by way of illustration, FIG. 1 shows a forearm postal tray device 10 made in accordance with the present invention. The forearm postal tray 10 includes an arched brace member 12 for setting upon a user's forearm. Arched brace member 12 has a pair of opposed and aligned slots 14*a*, and 14*b* (see FIG. 3) at each side end 16*a* and 16*b* respectively of arched brace member 12 cooperative for receiving strap 18 to secure the arched brace member 12 to the underside forearm of a user.

Figure 3:
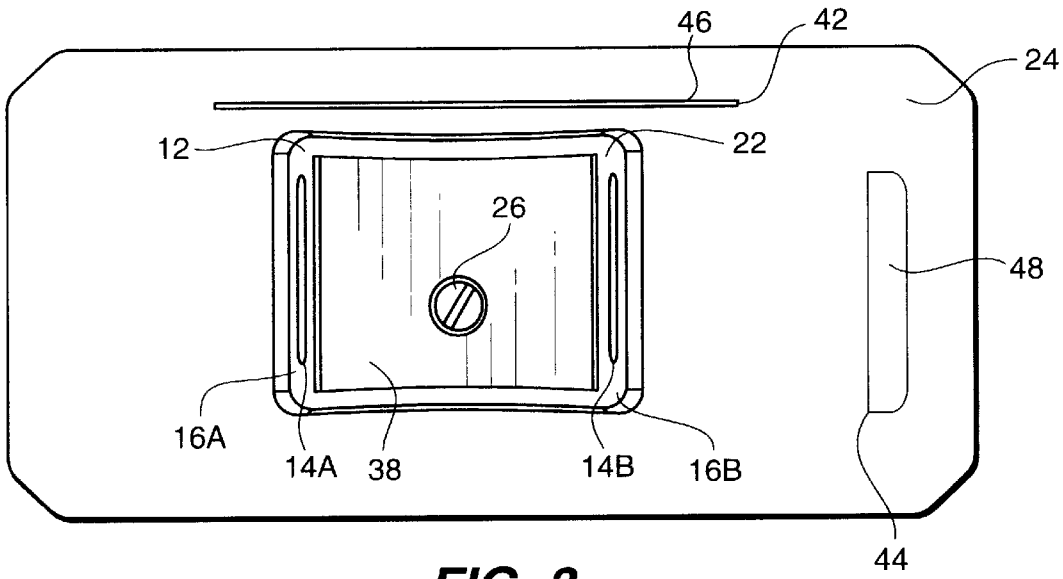
FIG. 3 is a bottom view of the forearm postal tray shown at FIG. 1 with the strap securing means thereof removed.

Arched brace member 12 has an exterior surface 20 and an interior surface 22 (again see FIG. 3). Tray plate 24, which serves as a supporting surface for articles of mail and the like, is connected to arched brace member 12 by means of connection screw 26. Connection screw 26 connecting the tray plate 24 to exterior surface 20 of arched brace member 12 allows tray plate 24 to swivel 360° such that the tray plate 24 may be rotatably adjusted for a selective setting upon arched brace member 12.

Figure 4:
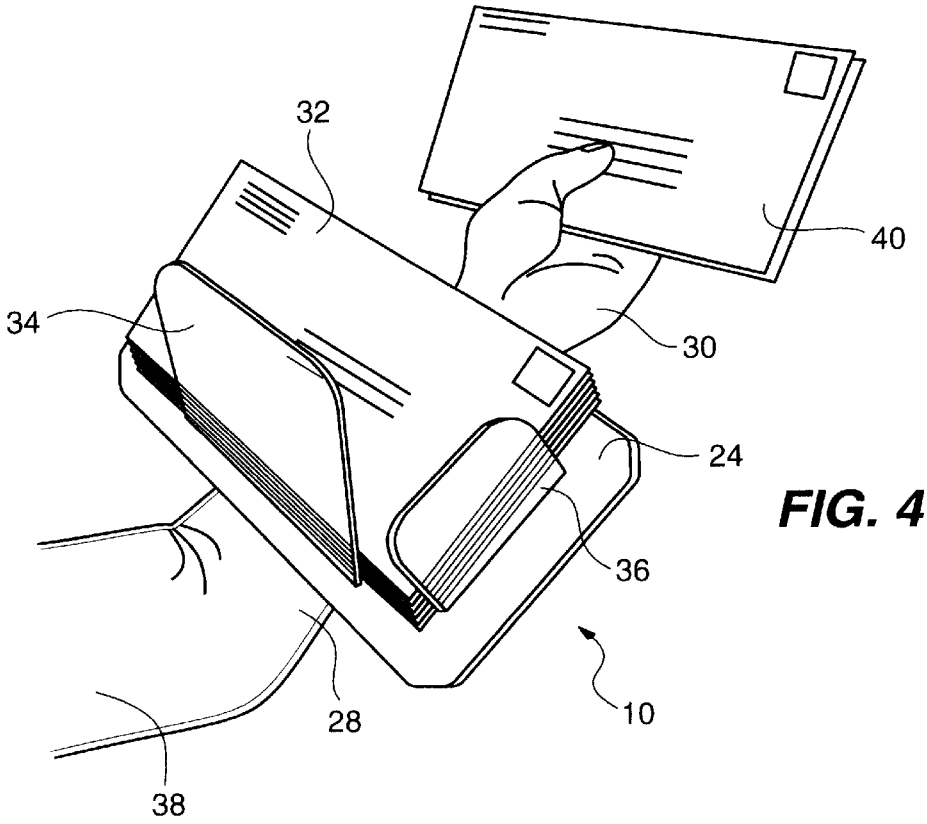
FIG. 4 is a perspective view of the forearm postal tray of FIG. 1 upon the forearm of a user during mail route delivery operations.

As best observed in FIG. 4, when the forearm postal tray 10 is affixed to the underside forearm 28 of a user, the user may extend his forearm in a manner such that hand 30 is forwardly extended from the forearm postal tray 10 and remains available while articles or bundles of mail 32 are held upon tray plate 24 by end wall 34 which serves as a border to a portion of the length of tray plate 24 and side wall 36 which serves as a border to a portion of the width of tray plate 24. End wall 34 prevents a backward displacement and side wall 36 prevents a lateral displacement of the mail 32 upon the tray plate 24 during usage of the forearm postal tray. Side wall 36 may extend upwardly of tray plate 24 at right angle 90° but preferably extends upward of tray plate 24 at an obtuse angle of approximately 110°. End wall 34 may also be set at a right angle to tray plate 24 but preferably extends upward from tray plate 24 at an acute angle of approximate 70° to accommodate the resting of mail articles upon the same while the forearm of a user is extended.

As noted in FIG. 4, when the forearm postal tray 12 of the present invention is worn on the underside forearm 28 of a user's left arm 38 an automated sequential bundle of mail 32 may be placed upon tray plate 24 and held in that position via end wall 34 and side wall 36 while the user's left hand

30 is free to hold, for example, a manually sequential bundle of mail 40 such that the user has his right hand free to aid in the examination, comparison, and collating of automated and the manual sequential mail bundles to confirm or adjust the integrity of the same and to also place the same in a combined sequential postal address sequence corresponding to the several points of route mail delivery.

Referring now to the bottom view of FIG. 3, arched brace member 12 includes a cushion liner 38 mounted upon the interior surface 22 of arched brace member 12 by glue or other suitable means. Cushion liner 38 may be constructed of rubber, enclosed foam, or other cushioning material to accommodate a comfortable seating of the arched brace member 12 upon the user's forearm.

The entire forearm postal tray 12, excepting the securing means and connection screw is preferably made as a unitary integral piece of a rubber or thermoplastic material. Alternatively, as illustrated in the drawings herein, end wall 34 and side wall 36 may be formed to fit within corresponding slots 42 and 44 respectively in an interference manner or by interference fit supplemented by a glue material such that end wall bottom edge 46 extends through slot 42 of tray plate 24 and side wall bottom edge 48 extends through slot 44 of tray plate 24.

It is believed that the forearm postal device 10 of the present invention and its numerous attendant advantages will be fully understood from the foregoing description, and that changes may be made in form, construction and arrangement of the several parts thereof without departing from the spirit or scope of the invention, or sacrificing any of the attendant advantages. The structure herein disclosed is a preferred embodiment of the invention for the purpose of illustrating the invention. Accordingly, the scope of the invention is only to be limited as necessitated by the accompanying claims.

I claim:

1. A forearm tray for facilitating sorting and delivery of articles of mail comprising:

an arched brace member for setting on a forearm of a user;

means for securing said brace member to the forearm of the user;

a tray plate having a first surface connected to said arched brace member and a second surface opposite said first surface, said tray plate having opposing first and second ends and opposing first and second sides;

a planar end wall connected adjacent to said first end of said tray plate and extending upwardly therefrom in a direction toward said second end of said tray plate such that an upper end of said planar end wall lies closer to a vertical axis extending perpendicularly from said second surface at said second end than a lower end of said planar end wall to define a first fixed partition having a planar surface facing said second surface; and a planar side wall connected adjacent to one of said first and second sides of said tray plate and extending upwardly therefrom to define a second fixed partition;

wherein when said forearm tray is secured to the forearm of the user by said securing means, said first end of said tray plate lies adjacent to the elbow on the same arm as the forearm of the user and said second end of said tray plate lies adjacent to the wrist on the same arm of the forearm of the user, said planar end wall extending toward said second end of said tray plate providing access of the articles of mail to and upon said second surface of said tray plate and holding the articles of mail by said fixed partitions on said second surface.

2. The forearm tray of claim 1 wherein said means for securing said brace member to the forearm of a user comprises said arched brace member having a pair of oppositely aligned slots cooperative with a securing strap.

3. The forearm tray of claim 1 wherein said tray plate is connected to said brace member by a screw.

4. The forearm tray of claim 1 wherein said end wall borders along a portion of the length of said tray plate.

5. The forearm tray of claim 1 wherein said side wall borders along a portion of the width of said tray plate.

6. The forearm tray of claim 1 wherein said side wall extends upward of said tray plate at an obtuse angel.

7. The forearm tray of claim 1 wherein said planar surface of said first fixed partition and said second surface of said tray plate define an angle therebetween of approximately 70°.

8. The forearm tray of claim 6 wherein said obtuse angle is approximately 110°.

9. The forearm tray of claim 1 wherein said arched brace member has an exterior surface and an interior surface and further includes a liner cushion mounted to said interior surface.

10. The forearm tray of claim 3 wherein said tray plate is rotatably and selectively connected to said brace member by said screw.

* * * * *